US010102942B2

(12) United States Patent
Ichikawa

(10) Patent No.: US 10,102,942 B2
(45) Date of Patent: Oct. 16, 2018

(54) ALUMINUM COMPOSITE TWISTED WIRE CONDUCTOR, ALUMINUM COMPOSITE TWISTED WIRE, AND WIRE HARNESS

(71) Applicant: Yazaki Corporation, Tokyo (JP)

(72) Inventor: Makoto Ichikawa, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/888,716

(22) Filed: Feb. 5, 2018

(65) Prior Publication Data

US 2018/0226175 A1 Aug. 9, 2018

(30) Foreign Application Priority Data

Feb. 6, 2017 (JP) ..... 2017-019227

(51) Int. Cl.

| | |
|---|---|
| ***H01B 7/00*** | (2006.01) |
| ***H01B 1/02*** | (2006.01) |
| ***H01B 7/02*** | (2006.01) |

(52) U.S. Cl.

CPC ..... *H01B 7/0045* (2013.01); *H01B 1/023* (2013.01); *H01B 7/02* (2013.01)

(58) Field of Classification Search

CPC ..... H01B 7/0045; H01B 1/023; H01B 7/02
USPC ..... 174/72 A
See application file for complete search history.

(56) References Cited

U.S. PATENT DOCUMENTS

2007/0251204 A1* 11/2007 Susai ..... H01B 13/0006 57/9
2016/0293292 A1* 10/2016 Oshima ..... H01B 7/0009

FOREIGN PATENT DOCUMENTS

| | | | |
|---|---|---|---|
| CN | 102800437 | * | 9/2014 |
| CN | 102800437 B | * | 9/2014 |
| JP | 2-8816 U1 | | 1/1990 |
| JP | 2005-259583 A | | 9/2005 |
| JP | 2006-156346 A | | 6/2006 |
| JP | 2016-197569 A | | 11/2016 |
| JP | 2016-212965 A | | 12/2016 |

* cited by examiner

*Primary Examiner* — Timothy Thompson
*Assistant Examiner* — Charles Pizzuto
(74) *Attorney, Agent, or Firm* — Sughrue Mion, PLLC

(57) ABSTRACT

An aluminum composite twisted wire conductor includes a center assembled twisted wire positioned closest to a center of the aluminum composite twisted wire conductor in cross-sectional view, a plurality of first-layer assembled twisted wires positioned around the center assembled twisted wire, and a plurality of second-layer assembled twisted wires positioned around the first-layer assembled twisted wires. Each of the center assembled twisted wire, the plurality of first-layer assembled twisted wires, and the plurality of second-layer assembled twisted wires is an assembled twisted wire. The assembled twisted wire comprises a plurality of aluminum strands which are collectively first-twisted and made of aluminum or an aluminum alloy. The center assembled twisted wire, the plurality of first-layer assembled twisted wires, and the plurality of second-layer assembled twisted wires are collectively second-twisted.

4 Claims, 6 Drawing Sheets

| | FIRST EMBODIMENT | SECOND EMBODIMENT | THIRD EMBODIMENT | FIRST COMPARATIVE EXAMPLE | SECOND COMPARATIVE EXAMPLE |
|---|---|---|---|---|---|
| NUMBER OF OCCURRENCE OF STRAND DISCONNECTION (TEN THOUSAND TIMES) | 2.3 | 2.2 | 2.0 | 1.7 | 2.3 |

ALUMINUM COMPOSITE TWISTED WIRE CONDUCTOR, ALUMINUM COMPOSITE TWISTED WIRE, AND WIRE HARNESS

CROSS REFERENCE TO RELATED APPLICATIONS

This application claims priority from Japanese Patent Application No. 2017-019227 filed on Feb. 6, 2017, the entire contents of which are incorporated herein by reference.

BACKGROUND OF THE INVENTION

Field of the Invention

The present invention relates to an aluminum composite twisted wire conductor, an aluminum composite twisted wire, and a wire harness.

Description of Related Art

In the related art, a plurality of copper strands are first-twisted to form an assembled twisted wire, and then the plurality of assembled twisted wires are secondly twisted to form a composite twisted wire conductor. In such a composite twisted wire conductor, the assembled twisted wires are stacked from the center. In the composite twisted wire conductor, a second twisting direction in each layer is set to be opposite to a second twisting direction of the adjacent layer in order to keep the outer diameter of the conductor to be more circular shape. However, in a case where the above configuration is employed to strands made of aluminum or an aluminum alloy which is degraded compared to copper in strength and elongation, the strands in the adjacent layers come into point contact with each other since the second twisting directions are opposite. Therefore, the strands may be easily disconnected, and a requirement for bending resistance comes to be unsatisfied.

There is disclosed a composite twisted wire conductor in which the first twisting and the second twisting both are set to be in the same direction (see, for example, the patent document 1: JP-A-2006-156346). In the composite twisting conductor, since the first twisting and the second twisting both are set to be in the same direction, the bending resistance can be improved. In other words, the strands of the assembled twisted wire come into surface contact with each other even between the adjacent layers, and the strands are hardly disconnected, so that the bending resistance is improved.

[Patent Literature 1] JP-A-2006-156346

According to a related art, in a composite twisted wire conductor, a bending resistance can be improved, but a strand of an assembled twisted wire of an outer layer easily enters between strands of the assembled twisted wire of an inner layer, and a shape of a composite twisted wire conductor is easily deformed due to a relation that a twisting directions are unified to the same direction. In a case where the shape is deformed, it leads to a deviation of a coating thickness, and also leads to a degradation in peeling workability.

SUMMARY

One or more embodiments to provide an aluminum composite twisted wire conductor, an aluminum composite twisted wire, and a wire harness which can prevent deterioration of the bending resistance while preventing deformation of the shape.

In an aspect (1), an aluminum composite twisted wire conductor includes a center assembled twisted wire positioned closest to a center of the aluminum composite twisted wire conductor in cross-sectional view, a plurality of first-layer assembled twisted wires positioned around the center assembled twisted wire, and a plurality of second-layer assembled twisted wires positioned around the first-layer assembled twisted wires. Each of the center assembled twisted wire, the plurality of first-layer assembled twisted wires, and the plurality of second-layer assembled twisted wires is an assembled twisted wire. The assembled twisted wire includes a plurality of aluminum strands which are collectively first-twisted and made of aluminum or an aluminum alloy. The center assembled twisted wire, the plurality of first-layer assembled twisted wires, and the plurality of second-layer assembled twisted wires are collectively second-twisted. Second twisting directions of the first-layer assembled twisted wire and the second-layer assembled twisted wire are the same. First twisting directions of the first-layer assembled twisted wire and the second-layer assembled twisted wire are the same as the second twisting directions of the first-layer assembled twisted wire and the second-layer. A first twisting direction of the center assembled twisted wire and the second twisting direction of the first-layer assembled twisted wire are opposite. Second twisting angles of the first-layer assembled twisted wire and the second-layer assembled twisted wire are almost the same.

According to the aspect (1), second twisting directions of a first-layer assembled twisted wire and a second-layer assembled twisted wire are the same, and first twisting directions of the first-layer assembled twisted wire and the second-layer assembled twisted wire are the same as the second twisting direction. Therefore, a contact area between aluminum strands of the first-layer assembled twisted wire and the second-layer assembled twisted wire is expanded, and it is possible to suppress a possibility of disconnection of the aluminum strand caused by friction. Further, the first twisting direction of the center assembled twisted wire and the second twisting direction of the first-layer assembled twisted wire are opposite. Herein, the inventor of this application has found out that, even when the first twisting direction of the center assembled twisted wire is made to be opposite to the second twisting direction of the first-layer assembled twisted wire, there is no significant deterioration in the bending performance. Therefore, when the twisting direction of the center assembled twisted wire is set to be opposite to the second twisting direction (and the first twisting direction) of the first-layer assembled twisted wire, the aluminum strand of the first-layer assembled twisted wire hardly enters between the aluminum strands of the center assembled twisted wire, and deformation of the shape can be prevented while preventing the deterioration of the bending performance. In addition, since the second twisting angle of the first-layer assembled twisted wire and the second-layer assembled twisted wire are almost the same, the contacting area between the aluminum strands of the first-layer assembled twisted wire and the second-layer assembled twisted wire can be increased, and the deterioration in the bending resistance can be prevented still more. Therefore, it is possible to provide the aluminum composite twisted wire conductor which can prevent the deterioration in the bending resistance while preventing deformation of the shape.

In an aspect (2), a difference between a sum of a first twisting angle and the second twisting angle of the first-layer assembled twisted wire, and a first twisting angle of the center assembled twisted wire is 15 degrees or more.

According to the aspect (2), since the difference between the sum of the first twisting angle and the second twisting angle of the first-layer assembled twisted wire, and the first twisting angle of the center assembled twisted wire is 15 degrees or more, a difference in the twisting angle becomes large (that is, the twisting pitch becomes small). Therefore, the deformation applied on the aluminum strand at the time of bending can be easily absorbed, and the bending resistance can be improved.

In an aspect (3), an aluminum composite twisted wire includes the aluminum composite twisted wire conductor according to the aspect (1) or (2), and an insulating coating portion which covers the aluminum composite twisted wire conductor.

According to the aspect (3), the aluminum composite twisted wire includes the aluminum composite twisted wire conductor and the insulating coating portion which covers the aluminum composite twisted wire conductor. Therefore, it is possible to provide the aluminum composite twisted wire which is excellent in peeling workability while keeping the thickness of the coating portion uniform.

In an aspect (4), a wire harness includes the aluminum composite twisted wire according to aspect (3).

According to the aspect (4), the wire harness includes the aluminum composite twisted wire. Therefore, it is possible to provide a wire harness suitable as the wire harness which is excellent in the bending resistance and used in a portion such as a slide door where bending is repeatedly performed. Further, the wire harness includes the aluminum composite twisted wire in which deformation of the shape is prevented and the peeling workability is improved, so that it is possible to suppress the frequency of occurrence of a defective product in manufacturing the wire harness.

According to one or more embodiments, it is possible to provide an aluminum composite twisted wire conductor, an aluminum composite twisted wire, and a wire harness which can prevent deterioration in the bending resistance while preventing deformation of the shape.

FIG. 1 is a configuration view illustrating an exemplary wire harness according to an embodiment of the invention.

FIGS. 2A and 2B are cross-sectional views illustrating an aluminum composite twisted wire 1 illustrated in FIG. 1. FIG. 2A illustrates a detailed cross-sectional view. FIG. 2B illustrates a cross-sectional view partially simplified.

Figure 6A:
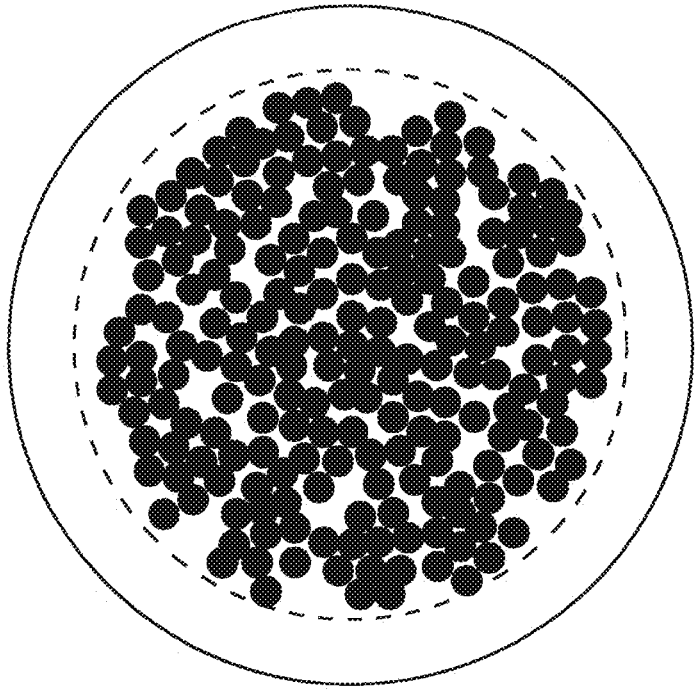
Figure 6B:
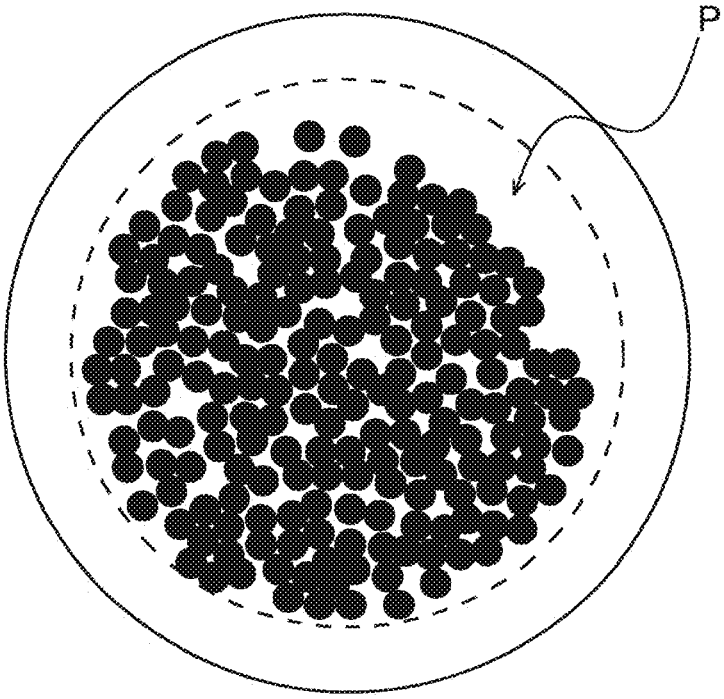

FIGS. 6A and 6B are configuration views illustrating cross sections of the aluminum composite twisted wires which include aluminum composite twisted wire conductors of a second embodiment and a second comparative example. FIG. 6A illustrates a cross section of the second embodiment. FIG. 6B illustrates a cross section of the second comparative example.

Figure 7:
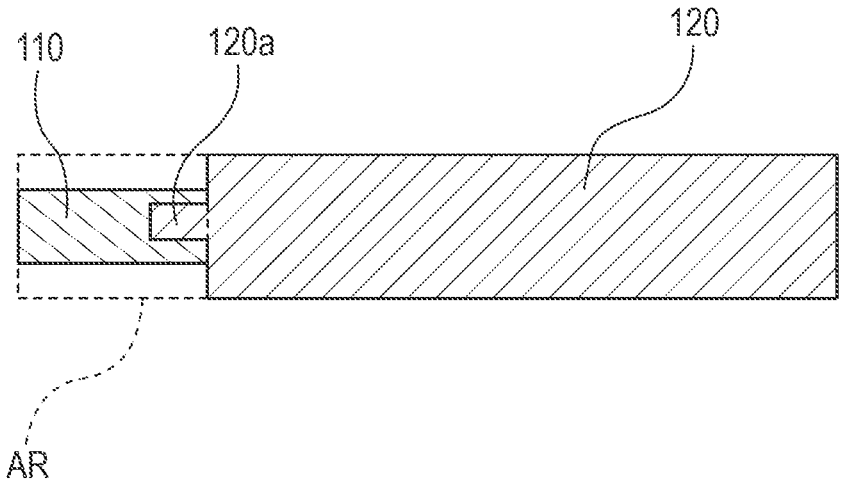

FIG. 7 is a view schematically illustrating an example of a peeling error.

Hereinafter, the invention will be described with reference to preferred embodiments. The invention is not limited to the embodiments below, and may be appropriately changed within a scope not departing from the spirit of the invention. In the embodiment described below, while some of the configurations are omitted in the drawings and the description, it is a matter of course that publicly-known or well-known techniques may be appropriately applied instead of the omitted technical details within a scope not causing discrepancies from the contents described below.

Figure 1:
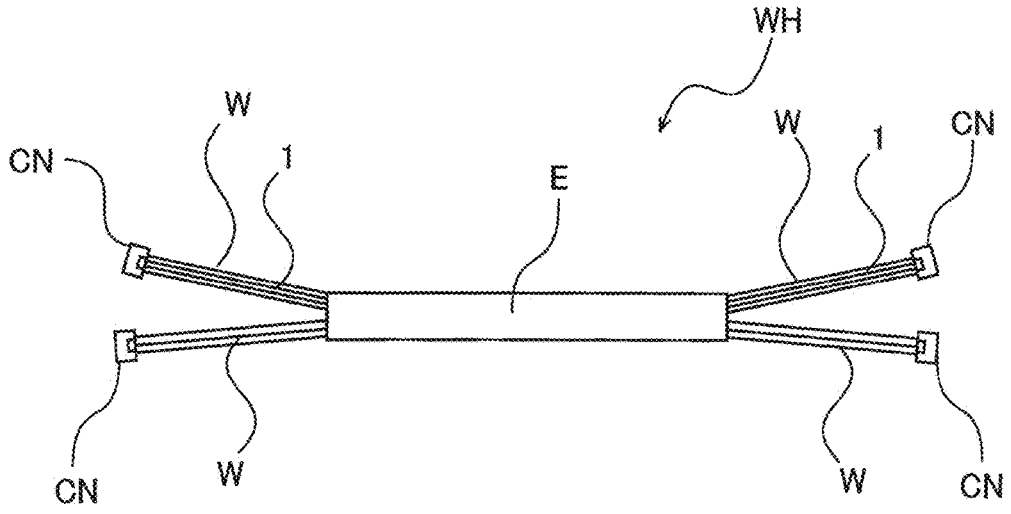

FIG. 1 is a diagram illustrating a configuration of an exemplary wire harness according to an embodiment of the invention. As illustrated in FIG. 1, a wire harness WH is formed of a plurality of electric wires W into bundles, and at least one of the plurality of electric wires W is formed of an aluminum composite twisted wire 1 described in detail below. The wire harness WH may include connectors CN on both sides of the electric wire W as illustrated in FIG. 1 for example, or may be wrapped with tapes (not illustrated) to combine the plurality of electric wires W. The wire harness WH may include an exterior component E such as a corrugate tube.

Figure 2A:
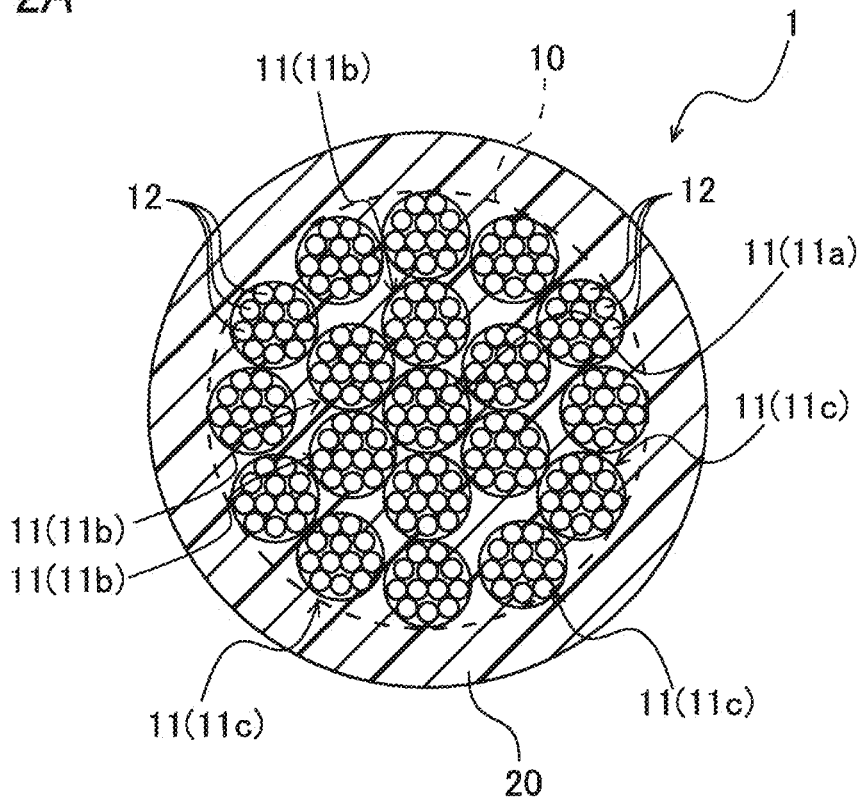
Figure 2B:
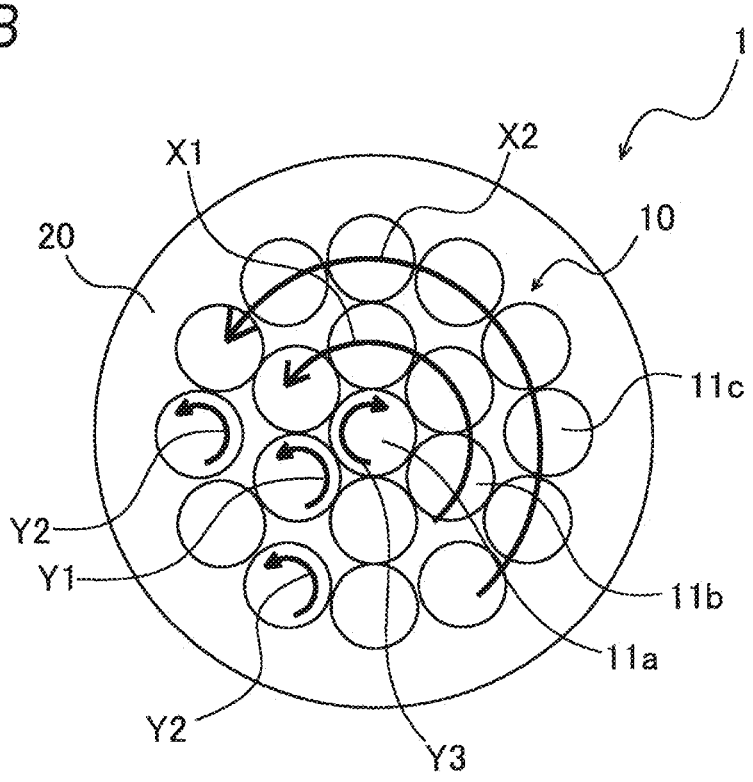

FIGS. 2A and 2B are cross-sectional views illustrating the aluminum composite twisted wire 1 illustrated in FIG. 1, in which FIG. 2A illustrates a cross section in detail, and FIG. 2B illustrates a cross section partially simplified.

As illustrated in FIGS. 2A and 2B, the aluminum composite twisted wire 1 is formed of an aluminum composite twisted wire conductor 10, and an insulating coating portion 20 with which the aluminum composite twisted wire is coated.

The aluminum composite twisted wire conductor 10 is formed of a plurality (for example, nineteen) of assembled twisted wires 11. The assembled twisted wire 11 is formed by first-twisting a plurality of aluminum strands 12 made of aluminum or an aluminum alloy. The aluminum composite twisted wire conductor 10 is formed by second-twisting a plurality of assembled twisted wires 11, in which the assembled twisted wires 11 are stacked in three layers.

Specifically, among the plurality of stacked assembled twisted wires 11, the assembled twisted wire 11 positioned closest to the center in the cross section is called a center assembled twisted wire 11*a*, the assembled twisted wire 11 provided to be overlapped on the center assembled twisted wire 11*a* is called a first-layer assembled twisted wire 11*b*, and the assembled twisted wire 11 provided to be overlapped on the first-layer assembled twisted wire 11*b* is called a second-layer assembled twisted wire 11*c*. The center assembled twisted wire 11*a* in this embodiment is formed of one wire, the first-layer assembled twisted wire 11*b* is formed of six wires, and the second-layer assembled twisted wire 11*c* is formed of twelve wires, but the invention is not limited to these numbers.

Herein, the aluminum composite twisted wire conductor 10 according to this embodiment has the following four features at the same time as illustrated in FIG. 2B so as to prevent deterioration in bending resistance while preventing deformation of the shape.

First, the aluminum composite twisted wire conductor 10 is configured such that the second twisting directions X1 and X2 of the plurality of first-layer assembled twisted wires 11*b* and the plurality of second-layer assembled twisted wires 11*c* are the same direction (first configuration). Second, the aluminum composite twisted wire conductor 10 is configured such that first twisting directions Y1 and Y2 of the first-layer assembled twisted wire 11*b* and the second-layer assembled twisted wire 11*c* is the same as the second twisting directions X1 and X2 (second configuration). With these configurations, a contact area between the aluminum strands 12 of the first-layer assembled twisted wire 11*b* and the second-layer assembled twisted wire 11*c* is expanded, and it is possible to suppress a possibility of disconnection of the aluminum strand 12 caused by friction.

Third, the aluminum composite twisted wire conductor 10 is configured such that a first twisting direction Y3 of the center assembled twisted wire 11*a* and the second twisting direction X1 of the first-layer assembled twisted wire 11*b* are opposite (third configuration). With the configuration, the aluminum strand 12 of the first-layer assembled twisted wire 11*b* hardly enters between the aluminum strands 12 of the center assembled twisted wire 11*a*, and it is possible to prevent deformation of the shape.

Fourth, the aluminum composite twisted wire conductor 10 is configured such that second twisting angles of the first-layer assembled twisted wire 11*b* and the second-layer assembled twisted wire 11*c* are almost the same (that is, a specific product having the same design may have a difference within ±1.5°) (fourth configuration). With the configuration, it is possible to increase the contact area between the aluminum strands 12 of the first-layer assembled twisted wire 11*b* and the second-layer assembled twisted wire 11*c*.

Next, the above-described twisting angle will be described.

wire 11*a* is placed in a linear shape. The second twisting angle of the second-layer assembled twisted wire 11*c* is also the same.

The aluminum composite twisted wire conductor 10 according to this embodiment employs the twisting angle of the fourth configuration.

Further, the aluminum composite twisted wire conductor 10 is configured such that a difference between a sum of the first twisting angle and the second twisting angle of the first-layer assembled twisted wire 11*b* and the first twisting angle of the center assembled twisted wire 11*a* is preferably 15 degrees or more (fifth configuration). With the configuration, a difference in the twisting angle becomes large (that is, a twisting pitch becomes small), so that distortion applied on the aluminum strand 12 at the time of bending can be easily absorbed, and the bending resistance can be improved.

Next, embodiments and comparative examples of the invention will be described. Table 1 is a table showing the embodiments and the comparative example.

TABLE 1

| | | Center assembled twisted wire | First-layer twisted wire | | Second-layer twisted wire | | Twisting angle difference [°] |
|---|---|---|---|---|---|---|---|
| | Twisting | First twisting | First twisting | Second twisting | First twisting | Second twisting | \|A − (B + C)\| |
| First embodiment | Direction | Z | S | S | S | S | 17.0 |
| | Pitch [mm] | 31 | 31 | 50 | 31 | 83 | |
| | Angle [°] | −4.5 | 4.5 | 8.0 | 4.5 | 8.0 | |
| Second embodiment | Direction | Z | S | S | S | S | 15.0 |
| | Pitch [mm] | 40 | 40 | 50 | 40 | 83 | |
| | Angle [°] | −3.5 | 3.5 | 8.0 | 3.5 | 8.0 | |
| Third embodiment | Direction | Z | S | S | S | S | 13.6 |
| | Pitch [mm] | 50 | 50 | 50 | 40 | 83 | |
| | Angle [°] | −2.8 | 2.8 | 8.0 | 3.5 | 8.0 | |
| First comparative example | Direction | S | Z | S | S | Z | 2.6 |
| | Pitch [mm] | 33 | 35 | 36 | 35 | 74 | |
| | Angle [°] | 4.2 | −4.2 | 11.0 | 4.0 | −9.0 | |
| Second comparative example | Direction | S | S | S | S | S | 8.0 |
| | Pitch [mm] | 31 | 31 | 50 | 31 | 83 | |
| | Angle [°] | 4.5 | 4.5 | 8.0 | 4.5 | 8.0 | |

Figure 3:
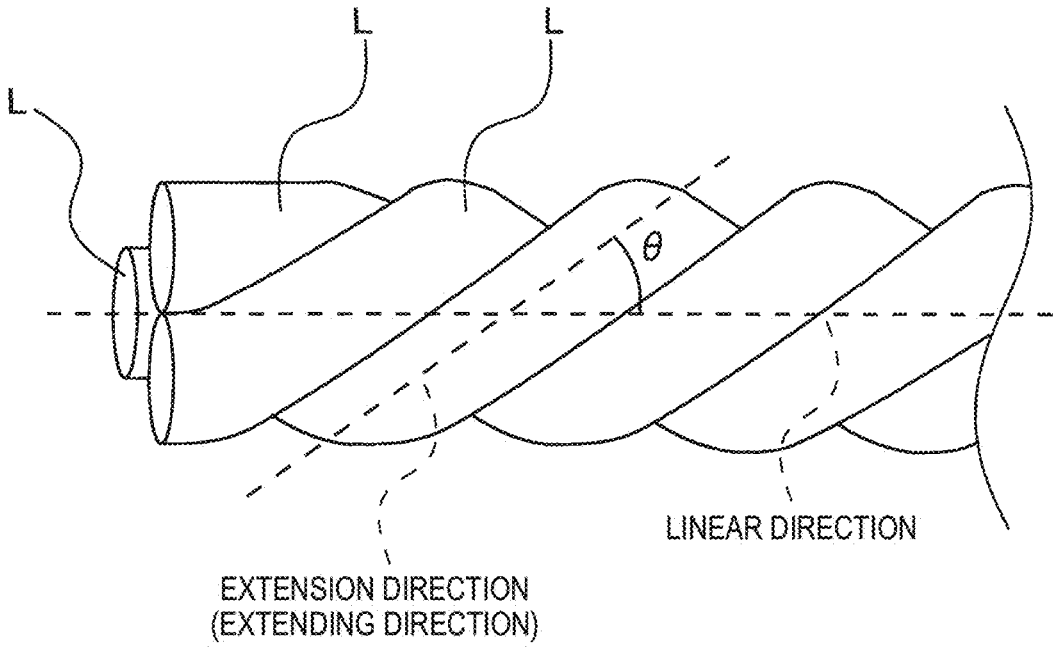
FIG. 3 is a concept view for describing a twisting angle.

FIG. 3 is a concept diagram for describing the twisting angle. As illustrated in FIG. 3, three wire materials L are twisted. The twisting angle refers to an angle θ formed between a linear direction and a direction of the wire material L in a case where three twisted wire materials L form a linear shape. Therefore, for example, a first twisting angle of the center assembled twisted wire 11*a* becomes an angle formed between the linear direction and the extending direction of the aluminum strand 12 in a case where the center assembled twisted wire 11*a* is placed in a linear shape. The first twisting angle of the first-layer assembled twisted wire 11*b* and the second-layer assembled twisted wire 11*c* is also the same. Further, the second twisting angle of the first-layer assembled twisted wire 11*b* becomes an angle formed between the linear direction and the extending direction of each first-layer assembled twisted wire 11*b* in a case where the first-layer assembled twisted wire 11*b* made by being secondly twisted on the center assembled twisted In a first embodiment, the center assembled twisted wire is configured to have the Z direction as the first twisting direction. On the contrary, the first-layer assembled twisted wire and the second-layer assembled twisted wire are configured to have an S direction as both of the first twisting direction and the second twisting direction. In other words, the first embodiment includes the first to third configurations. In the first embodiment, a first twisting pitch of the center assembled twisted wire, a first twisting pitch of the first-layer assembled twisted wire, a second twisting pitch of the first-layer assembled twisted wire, a first twisting pitch of the second-layer assembled twisted wire, and a second twisting pitch of the second-layer assembled twisted wire are 31 mm, 31 mm, 50 mm, 31 mm, and 83 mm. Further, in the first embodiment, the first twisting angle of the center assembled twisted wire, the first twisting angle of the first-layer assembled twisted wire, the second twisting angle of the first-layer assembled twisted wire, the first twisting angle of the second-layer assembled twisted wire, and the second twisting angle of the second-layer assembled twisted wire are −4.5°, 4.5°, 8.0°, 4.5°, and 8.0°. In other words, the first embodiment includes the fourth configuration. Calculating the angle, a difference between a sum of a first twisting angle B and a second twisting angle C of the first-layer assembled twisted wire, and a first twisting angle A of the center assembled twisted wire becomes 17.0°, and thus the first embodiment includes the fifth configuration.

A second embodiment is the same as the first embodiment in the first twisting direction of the center assembled twisted wire, and the first twisting direction and the second twisting direction of the first-layer assembled twisted wire and the second-layer assembled twisted wire, and includes the first to third configurations. In the second embodiment, the first twisting pitch of the center assembled twisted wire, the first twisting pitch of the first-layer assembled twisted wire, the second twisting pitch of the first-layer assembled twisted wire, the first twisting pitch of the second-layer assembled twisted wire, and the second twisting pitch of the second-layer assembled twisted wire become 40 mm, 40 mm, 50 mm, 40 mm, and 83 mm. Further, in the second embodiment, the first twisting angle of the center assembled twisted wire, the first twisting angle of the first-layer assembled twisted wire, the second twisting angle of the first-layer assembled twisted wire, the first twisting angle of the second-layer assembled twisted wire, and the second twisting angle of the second-layer assembled twisted wire become −3.5°, 3.5°, 8.0°, 3.5°, and 8.0°, and includes the fourth configuration. Calculating the angle, the second embodiment has |A−(B+C)| of 15.0°, and includes the fifth configuration.

A third embodiment is configured such that the first twisting direction of the center assembled twisted wire, and the first twisting direction and the second twisting direction of the first-layer assembled twisted wire and the second-layer assembled twisted wire are the same as the first embodiment, and includes the first to third configurations. In the third embodiment, the first twisting pitch of the center assembled twisted wire, the first twisting pitch of the first-layer assembled twisted wire, the second twisting pitch of the first-layer assembled twisted wire, the first twisting pitch of the second-layer assembled twisted wire, and the second twisting pitch of the second-layer assembled twisted wire become 50 mm, 50 mm, 50 mm, 40 mm, and 83 mm. Further, the third embodiment is configured such that the first twisting angle of the center assembled twisted wire, the first twisting angle of the first-layer assembled twisted wire, the second twisting angle of the first-layer assembled twisted wire, the first twisting angle of the second-layer assembled twisted wire, and the second twisting angle of the second-layer assembled twisted wire become −2.8°, 2.8°, 8.0°, 3.5°, and 8.0°, and includes the fourth configuration. Calculating the angle, the third embodiment has |A−(B+C)| of 13.6°, and does not include the fifth configuration.

In a first comparative example, the first twisting direction of the center assembled twisted wire is the S direction. The first-layer assembled twisted wire has the Z direction as the first twisting direction, and the S direction as the second twisting direction. The second-layer assembled twisted wire has the S direction as the first twisting direction, and the Z direction as the second twisting direction. In other words, the first comparative example does not include the first to third configurations. In the first comparative example, the first twisting pitch of the center assembled twisted wire, the first twisting pitch of the first-layer assembled twisted wire, the second twisting pitch of the first-layer assembled twisted wire, the first twisting pitch of the second-layer assembled twisted wire, and the second twisting pitch of the second-layer assembled twisted wire become 33 mm, 35 mm, 36 mm, 35 mm, and 74 mm. Further, in the first comparative example, the first twisting angle of the center assembled twisted wire, the first twisting angle of the first-layer assembled twisted wire, the second twisting angle of the first-layer assembled twisted wire, the first twisting angle of the second-layer assembled twisted wire, and the second twisting angle of the second-layer assembled twisted wire become 4.2°, −4.2°, 11.0°, 4.0°, and −9.0°. In other words, the first comparative example does not include the fourth configuration. Calculating the angle, the first comparative example has |A−(B+C)| of 2.6°, and also does not include the fifth configuration. The first comparative example corresponds to the composite twisted wire conductor described in the related art above.

In a second comparative example, the first twisting direction of the center assembled twisted wire, the first twisting direction and the second twisting direction of the first-layer assembled twisted wire, and the first twisting direction and the second twisting direction of the second-layer assembled twisted wire are all the S direction. In other words, the second comparative example includes the first and second configurations but not the third configuration. In the second comparative example, the first twisting pitch of the center assembled twisted wire, the first twisting pitch of the first-layer assembled twisted wire, the second twisting pitch of the first-layer assembled twisted wire, the first twisting pitch of the second-layer assembled twisted wire, and the second twisting pitch of the second-layer assembled twisted wire become 31 mm, 31 mm, 50 mm, 31 mm, and 83 mm. Further, the second comparative example is configured such that the first twisting angle of the center assembled twisted wire, the first twisting angle of the first-layer assembled twisted wire, the second twisting angle of the first-layer assembled twisted wire, the first twisting angle of the second-layer assembled twisted wire, and the second twisting angle of the second-layer assembled twisted wire become 4.5°, 4.5°, 8.0°, 4.5°, and 8.0°, and includes the fourth configuration. However, calculating the angle, the second comparative example has |A−(B+C)| of 8.0°, and does not include the fifth configuration. The second comparative example corresponds to the composite twisted wire conductor disclosed in JP-A-2006-156346.

Figure 4:
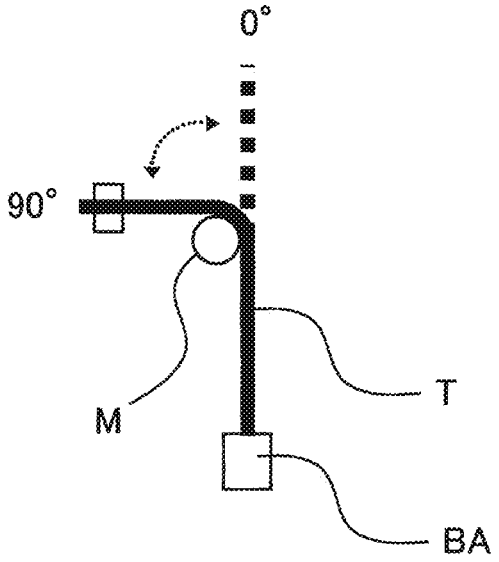
FIG. 4 is a schematic view illustrating a result of a bending test.

The aluminum composite twisted wire conductors of the first to third embodiments and the first and second comparative examples have been subjected to a bending test. FIG. 4 is a diagram schematically illustrating the results of the bending test. In the bending test, one end is fixed by a fixing tool BA, and the other end is repeatedly bent within an angular range from −0° to 90° using a ϕ25-mm mandrel M at room temperature at a speed of 30 rpm. Then, the number of bending (the number of reciprocating motions) has been measured when a certain number of aluminum strands are disconnected (that is, a resistance value of an aluminum composite twisted wire conductor T is increased 10% than before the bending test).

Figure 5:
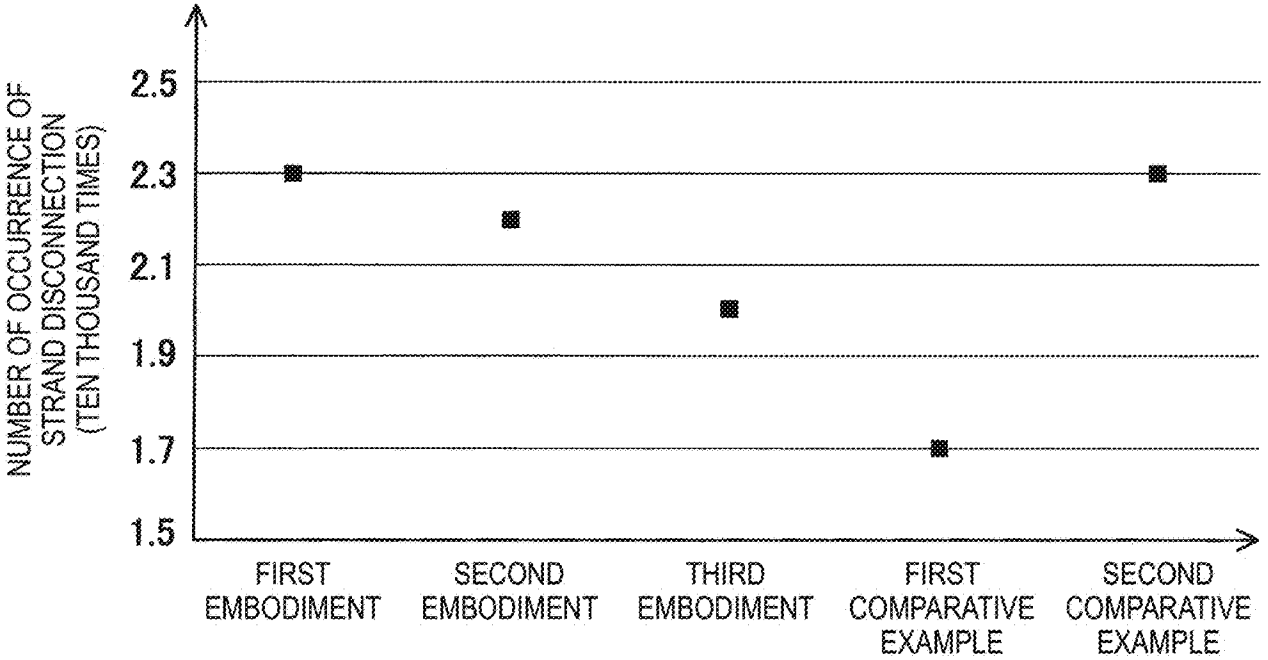
FIG. 5 is a table showing results of the bending test according to the embodiments and comparative examples.

FIG. 5 is a table showing results of the bending test according to the embodiments and the comparative examples. As illustrated in FIG. 5, in the first embodiment, strand disconnection has occurred at 23,000 bendings (the resistance value is increased by 10%). In the second and third embodiments, the strand disconnection has occurred at 22,000 and 20,000 bendings respectively. In the first comparative example, the strand disconnection has occurred at 17,000 bendings. In the second comparative example, the strand disconnection has occurred at 23,000 bendings.

As described above, the number of strand disconnections becomes 20,000 or more in all of the first to third embodiments, and it can be seen that the bending resistance is excellent over the first comparative example.

FIGS. 6A and 6B are diagrams illustrating cross sections of the aluminum composite twisted wires which include the aluminum composite twisted wire conductors of the second embodiment and the second comparative example, in which FIG. 6A illustrates a cross section of the second embodiment, and FIG. 6B illustrates a cross section of the second comparative example.

As illustrated in FIG. 6A, a circularity of the aluminum composite twisted wire conductor is high to some degrees in the aluminum composite twisted wire according to the second embodiment. Therefore, a thickness of the coating portion is uniformized. On the contrary, as illustrated in FIG. 6B, the circularity of the aluminum composite twisted wire conductor is low in the aluminum composite twisted wire according to the second comparative example. Therefore, the thickness of the coating portion becomes partially large (see symbol P). Even the other first and third embodiments are similar to the second embodiment, and the first comparative example is also similar to the second comparative example.

FIG. 7 is a diagram schematically illustrating an example of a peeling error. As illustrated in FIG. 7, in a case where a coating portion 120 covering a conductor 110 is peeled off, a cut end 120*a* of the coating portion 120 is left in a peeling area AR of the coating portion 120, which becomes the peeling error.

Table 2 is a table showing results of the peeling test of the aluminum composite twisted wires which include the aluminum composite twisted wire conductors of the embodiments and the comparative examples. In the peeling test shown in Table 2, the coating portion is peeled off using a knife such that the coating portion is peeled off along the circle portion indicated by a broken line of FIG. 6.

TABLE 2

| Embodiment | Comparative example |
|---|---|
| 0/50 | 10/50 |

As illustrated in Table 2, the peeling has been performed fifty times on the aluminum composite twisted wires which include the aluminum composite twisted wire conductors of the first to third embodiments, and as a result there is no left cut end 120*a* as illustrated in FIG. 7 in all the first to third embodiments. On the contrary, the cut end 120*a* as illustrated in FIG. 7 is left ten times on average in the first and second comparative examples.

From those described above, it can be seen that the circularities of the aluminum composite twisted wire conductors in all the first to third embodiments are higher than those of the first and second comparative examples, and deformation of the shape is prevented.

A number of aluminum composite twisted wire conductors of the first to third embodiments have been created and the twisting angles of the first-layer assembled twisted wire and the second-layer assembled twisted wire designed to be in the same second twisting angle have been measured, and as a result it can be seen that the angle difference falls into 1.5° or less and does not exceed this range.

Therefore, according to the aluminum composite twisted wire conductor 10 of this embodiment, the second twisting directions X1 and X2 of the first-layer assembled twisted wire 11*b* and the second-layer assembled twisted wire 11*c* are the same direction, the first twisting directions Y1 and Y2 of the first-layer assembled twisted wire 11*b* and the second-layer assembled twisted wire 11*c* are the same as the second twisting direction X1, the contact area of the aluminum strands 12 of the first-layer assembled twisted wire 11*b* and the second-layer assembled twisted wire 11*c* are widened, so that it is possible to suppress a possibility of the disconnection of the aluminum strand 12 caused by friction. Further, the first twisting direction Y3 of the center assembled twisted wire 11*a* and the second twisting direction X1 of the first-layer assembled twisted wire 11*b* are opposite. Herein, the inventor of this application has found out that, even when the first twisting direction Y3 of the center assembled twisted wire 11*a* is made to be opposite to the second twisting direction X1 of the first-layer assembled twisted wire 11*b*, there is no significant deterioration in the bending performance. Therefore, when the twisting direction of the center assembled twisted wire 11*a* is set to be opposite to the second twisting direction X1 (and the first twisting direction Y1) of the first-layer assembled twisted wire 11*b*, the aluminum strand 12 of the first-layer assembled twisted wire 11*b* hardly enters between the aluminum strands 12 of the center assembled twisted wire 11*a*, and deformation of the shape can be prevented while preventing the deterioration of the bending performance. In addition, since the second twisting angle of the first-layer assembled twisted wire 11*b* and the second-layer assembled twisted wire 11*c* are almost the same, the contacting area between the aluminum strands 12 of the first-layer assembled twisted wire 11*b* and the second-layer assembled twisted wire 11*c* can be increased, and the deterioration in the bending resistance can be prevented still more. Therefore, it is possible to provide the aluminum composite twisted wire conductor 10 which can prevent the deterioration in the bending resistance while preventing deformation of the shape.

Since a difference between a sum of the first twisting angle and the second twisting angle of the first-layer assembled twisted wire 11*b*, and the first twisting angle of the center assembled twisted wire 11*a* is 15 degrees or more, a difference in the twisting angle becomes large (that is, the twisting pitch becomes small). Therefore, the deformation applied on the aluminum strand 12 at the time of bending can be easily absorbed, and the bending resistance can be improved.

According to the aluminum composite twisted wire 1 of this embodiment, the aluminum composite twisted wire 1 includes the aluminum composite twisted wire conductor 10 and the insulating coating portion 20 which covers the aluminum composite twisted wire conductor. Therefore, it is possible to provide the aluminum composite twisted wire 1 which is excellent in peeling workability while keeping the thickness of the coating portion 20 uniform.

According to the wire harness WH of this embodiment, the wire harness WH includes the aluminum composite twisted wire 1. Therefore, it is possible to provide a wire harness which is suitable as the wire harness WH which is excellent in the bending resistance and used in a portion such as a slide door where bending is repeatedly performed. Further, the wire harness includes the aluminum composite twisted wire 1 in which deformation of the shape is prevented and the peeling workability is improved, so that it is possible to suppress the frequency of occurrence of a defective product in manufacturing the wire harness WH.

Hitherto, the description has been given based on the embodiments, but the invention is not limited to the above embodiment. Changes may be made within a scope not departing from the spirit of the invention, and other techniques (including well-known and publicly-known techniques) may be combined.

For example, the aluminum composite twisted wire 1 according to this embodiment has been described to include one center assembled twisted wire 11*a*, but the invention is not limited thereto. The center assembled twisted wire 11*a* may be provided by three or more.

The aluminum composite twisted wire 1 according to this embodiment has been described to prevent the deterioration in the bending resistance, but the invention is not limited only for a bent portion. The aluminum composite twisted wire may be provided in a linear portion.

DESCRIPTION OF REFERENCE NUMERALS AND SIGNS

1 . . . aluminum composite twisted wire
10 . . . aluminum composite twisted wire conductor
11 . . . assembled twisted wire
11*a* . . . center assembled twisted wire
11*b* . . . first-layer assembled twisted wire
11*c* . . . second-layer assembled twisted wire
12 . . . aluminum strand
20 . . . coating portion
W . . . electric wire
WH . . . wire harness

What is claimed is:

1. An aluminum composite twisted wire conductor comprising:

a center assembled twisted wire positioned closest to a center of the aluminum composite twisted wire conductor in cross-sectional view;

a plurality of first-layer assembled twisted wires positioned around the center assembled twisted wire; and a plurality of second-layer assembled twisted wires positioned around the first-layer assembled twisted wires, wherein each of the center assembled twisted wire, the plurality of first-layer assembled twisted wires, and the plurality of second-layer assembled twisted wires is an assembled twisted wire, wherein the assembled twisted wire comprises a plurality of aluminum strands which are collectively first-twisted and made of aluminum or an aluminum alloy, wherein the center assembled twisted wire, the plurality of first-layer assembled twisted wires, and the plurality of second-layer assembled twisted wires are collectively second-twisted, wherein second twisting directions of the first-layer assembled twisted wire and the second-layer assembled twisted wire are the same, wherein first twisting directions of the first-layer assembled twisted wire and the second-layer assembled twisted wire are the same as the second twisting directions of the first-layer assembled twisted wire and the second-layer, wherein a first twisting direction of the center assembled twisted wire and the second twisting direction of the first-layer assembled twisted wire are opposite, and wherein second twisting angles of the first-layer assembled twisted wire and the second-layer assembled twisted wire are almost the same.

2. The aluminum composite twisted wire conductor according to claim 1, wherein a difference between a sum of a first twisting angle and the second twisting angle of the first-layer assembled twisted wire, and a first twisting angle of the center assembled twisted wire is 15 degrees or more.

3. An aluminum composite twisted wire comprising:

the aluminum composite twisted wire conductor according to claim 1; and an insulating coating portion which covers the aluminum composite twisted wire conductor.

4. A wire harness comprising:

the aluminum composite twisted wire according to claim 3.

* * * * *